US012188174B1

(12) United States Patent
Zhang et al.

(10) Patent No.: US 12,188,174 B1
(45) Date of Patent: Jan. 7, 2025

(54) IRONING DEVICE

(71) Applicant: Shenzhen Shouzheng Chuqi Technology Co., Ltd, Guangdong (CN)

(72) Inventors: Yuyang Zhang, Guangdong (CN); Jin Li, Guangdong (CN)

(73) Assignee: Shenzhen Shouzheng Chuqi Technology Co., Shenzhen (CN)

( * ) Notice: Subject to any disclaimer, the term of this patent is extended or adjusted under 35 U.S.C. 154(b) by 0 days.

(21) Appl. No.: 18/794,094

(22) Filed: Aug. 5, 2024

(51) Int. Cl.

| | |
|---|---|
| ***D06F 75/30*** | (2006.01) |
| ***D06F 75/18*** | (2006.01) |
| ***D06F 75/20*** | (2006.01) |
| ***D06F 75/34*** | (2006.01) |
| ***D06F 87/00*** | (2006.01) |

(52) U.S. Cl.
CPC ..... *D06F 75/30* (2013.01); *D06F 75/18* (2013.01); *D06F 75/20* (2013.01); *D06F 75/34* (2013.01); *D06F 87/00* (2013.01)

(58) Field of Classification Search
CPC ..... D06F 75/30; D06F 75/14; D06F 75/16; D06F 75/18; D06F 75/20
See application file for complete search history.

(56) References Cited

U.S. PATENT DOCUMENTS

| | | | | |
|---|---|---|---|---|
| 3,577,859 | A * | 5/1971 | Davidson | D06F 75/30 219/245 |
| 7,121,024 | B1 * | 10/2006 | Clevenberg | D06F 71/32 38/25 |
| 2010/0000130 | A1 * | 1/2010 | Ng | D06F 81/08 38/77.83 |
| 2023/0193553 | A1 * | 6/2023 | Toll | D06F 75/14 38/85 |
| 2024/0209564 | A1 * | 6/2024 | Lai | D06F 75/34 |

* cited by examiner

*Primary Examiner* — Nathan E Durham
(74) *Attorney, Agent, or Firm* — Justin Lampel

(57) ABSTRACT

An ironing device includes: a housing, provided with a first mounting cavity, and a clip ironing steam port and a hanging ironing steam port that are connected to the first mounting cavity, where the clip ironing steam port and the hanging ironing steam port are disposed opposite to each other; a steam generation assembly, disposed in the first mounting cavity and connected to the clip ironing steam port and the hanging ironing steam port; and a clamping plate, rotatably connected to the housing and disposed opposite to the clip ironing steam port. The ironing device can implement functions of clip ironing and hanging ironing of clothing via the clip ironing steam port and the hanging ironing steam port that are disposed opposite to each other and the clamping plate. The ironing device can better adapt to different use scenarios, so that user experience is improved to a greater extent.

13 Claims, 6 Drawing Sheets

IRONING DEVICE

TECHNICAL FIELD

The present disclosure relates to the technical field of household appliances, in particular to an ironing device.

BACKGROUND

With the continuous improvement of quality of life, related electric appliances for ironing clothes enter thousands of families, for example, commercially available hanging ironing machines and clip ironing machines. The hanging ironing machines and clip ironing machines are used in different scenarios although being electric appliances for ironing clothes at home. The hanging ironing machine is used for ironing a whole piece of clothing, and is more suitable for ironing whole large pieces of clothing such as a dress. The clip ironing machine is more suitable for ironing clothing with small areas or specific locations, such as collars, cuffs, and the like. Therefore, to better meet requirements in different scenarios, the hanging ironing machine and clip ironing machine are usually available. This is inconvenient for use. To be specific, an existing ironing machine has relatively single functions, and is difficult to meet the needs of users.

SUMMARY

An objective of the present disclosure is to provide an ironing device, to enable the ironing device to have functions of hanging ironing and clip ironing.

To achieve the above objective, the present disclosure provides an ironing device. The ironing device includes:

- a housing, provided with a first mounting cavity, and a clip ironing steam port and a hanging ironing steam port that are connected to the first mounting cavity, where the clip ironing steam port and the hanging ironing steam port are disposed opposite to each other;
- a steam generation assembly, disposed in the first mounting cavity and connected to the clip ironing steam port and the hanging ironing steam port; and
- a clamping plate, rotatably connected to the housing and disposed opposite to the clip ironing steam port.

In an optional embodiment, the steam generation assembly includes a directional valve mounted in the first mounting cavity, a steam generator, and a water pump, the steam generator is connected to the clip ironing steam port and the hanging ironing steam port, and the directional valve is connected to the steam generator and the water pump.

In an optional embodiment, the ironing device includes a controller and a switching structure, the controller is mounted on the clamping plate and in communication connection to the directional valve, and the switching structure is in communication connection to the controller and configured to control the directional valve to deliver steam to the clip ironing steam port or the hanging ironing steam port.

In an optional embodiment, the switching structure includes a Hall switch and a magnetic member, the Hall switch is in communication connection to the controller, and the magnetic member is mounted in the housing and moves relative to the clamping plate.

In an optional embodiment, the ironing device further includes a locking structure, where the locking structure is mounted on the housing and the clamping plate, and the magnetic member is mounted on the locking structure; and the locking structure connects or releases the housing and the clamping plate.

In an optional embodiment, the locking structure includes a sliding latch and a latch slot provided in the clamping plate, the sliding latch is connected to the housing, and the magnetic member is connected to the sliding latch; and the sliding latch is slidably snapped into the latch slot, and the magnetic member triggers the Hall switch.

In an optional embodiment, a connection shaft hole is provided at an end, away from the latch slot, of the clamping plate, and a connection shaft is disposed at an end, away from the sliding latch, of the housing, and the connection shaft is rotatably nested in the connection shaft hole.

In an optional embodiment, the housing includes a main housing, a first clip ironing plate, and a hanging ironing plate, the first clip ironing plate and the hanging ironing plate are detachably connected to the main housing and enclosed with the main housing, to form the first mounting cavity, the clip ironing steam port is provided in the first clip ironing plate, and the hanging ironing steam port is provided in the hanging ironing plate.

In an optional embodiment, the ironing device further includes a heating sheet and a second clip ironing plate, where the second clip ironing plate is mounted on the clamping plate and corresponds to the first clip ironing plate, and the heating sheet is mounted on the clamping plate and attached to a surface of the second clip ironing plate.

In an optional embodiment, the clip ironing steam port includes a plurality of clip ironing holes, and the plurality of clip ironing holes are spaced apart from the first clip ironing plate; and the hanging ironing steam port includes a plurality of hanging ironing holes, and the plurality of the hanging ironing holes are spaced apart in the hanging ironing plate.

In the present disclosure, the ironing device includes the housing. The housing is provided with the first mounting cavity, and the clip ironing steam port and the hanging ironing steam port that are connected to the first mounting cavity. The clip ironing steam port and the hanging ironing steam port are disposed opposite to each other. The steam generation assembly is disposed in the first mounting cavity and connected to the clip ironing steam port and the hanging ironing steam port. The clamping plate is rotatably connected to the housing and disposed opposite to the clip ironing steam port. In the present disclosure, the ironing device can implement the functions of clip ironing and hanging ironing of clothing via the clip ironing steam port and the hanging ironing steam port that are disposed opposite to each other and the clamping plate. Specifically, during clip ironing, the steam generation assembly outputs steam to the clip ironing steam port, the clamping plate rotates upwardly relative to the housing, and the clothing can be placed between the steam generation assembly and the clamping plate for ironing. During hanging ironing, the steam generation assembly outputs steam to the hanging ironing steam port, and the housing is attached to a surface of the clothing for hanging ironing. In this way, the ironing device in the present disclosure has functions of hanging ironing and clip ironing, which can better adapt to different use scenarios, so that user experience is improved to a greater extent.

BRIEF DESCRIPTION OF THE DRAWINGS

To describe the technical solutions in the embodiments of the present disclosure or in the prior art more clearly, the following briefly describes the drawings required for describing the embodiments or the prior art. Apparently, the drawings in the following description show some embodiments of the present disclosure, and persons of ordinary skill in the art may still derive other drawings from these drawings without creative efforts.

REFERENCE NUMERALS

Figure 1:
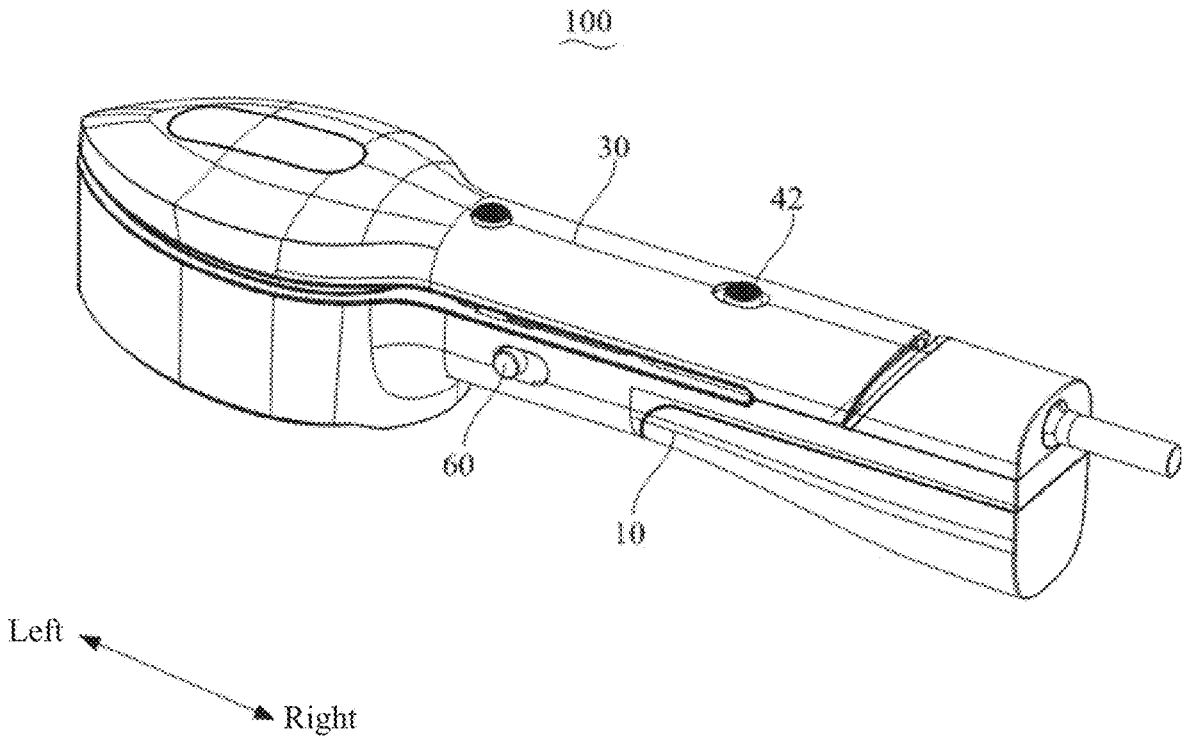
FIG. 1 is a schematic diagram of a structure of a status of an ironing device according to an embodiment of the present disclosure.

| No. | Name | No. | Name |
|---|---|---|---|
| 100 | ironing device | 30 | clamping plate |
| 10 | housing | 30a | connection shaft hole |
| 10a | first mounting cavity | 30b | second mounting cavity |
| 10b | clip ironing steam port | 31 | second clip ironing plate |
| 10c | hanging ironing steam port | 40 | controller |
| 11 | main housing | 41 | control circuit board |
| 12 | first clip ironing plate | 42 | control switch |
| 13 | hanging ironing plate | 51 | Hall switch |
| 14 | connection shaft | 52 | magnetic member |
| 20 | steam generation assembly | 60 | locking structure |
| 21 | directional valve | 61 | sliding latch |
| 22 | steam generator | 62 | latch slot |
| 221 | heating tube | 70 | heating sheet |
| 23 | water pump | | |

The implementation of the objective, functional characteristics and advantages of the present disclosure will be further described below with reference to the embodiments and the accompanying drawings.

DETAILED DESCRIPTION OF THE EMBODIMENTS

The technical solutions in embodiments of the present disclosure will be described below clearly and completely with reference to the accompanying drawings in the embodiments of the present disclosure. Apparently, the described embodiments are merely a part, rather than all of the embodiments of the present disclosure. All other embodiments obtained by those of ordinary skill in the art based on the embodiments of the present disclosure without creative efforts shall fall within the protection scope of the present disclosure.

It should be noted that all directional indications (such as up, down, left, right, front, rear . . . ) in the embodiments of the present disclosure are only used to explain relative positional relationship between various components and movement under a certain posture (as shown in the accompanying drawings). If the specific posture changes, the directional indication changes accordingly.

In addition, descriptions such as "first" and "second" in the present disclosure are only for the purpose of description, and should not be interpreted as indicating or implying their relative importance or implicitly indicating the number of indicated technical features. Therefore, a feature limited by "first" or "second" may explicitly or implicitly include at least one such feature. Further, the technical solutions of the various embodiments may be combined together on the basis that the combination is implementable by those of ordinary skill in the art. In case a combination of the technical solutions is contradictory or infeasible, such a combination is deemed inexistent and not falling within the protection scope of the present disclosure.

Referring to FIG. 1 to FIG. 6, the present disclosure provides an ironing device 100.

In an embodiment of the present disclosure, the ironing device 100 includes: a housing 10, a steam generation assembly 20, and a clamping plate 30. The housing 10 is provided with a first mounting cavity 10*a*, and a clip ironing steam port 10*b* and a hanging ironing steam port 10*c* that are connected to the first mounting cavity 10*a*. The clip ironing steam port 10*b* and the hanging ironing steam port 10*c* are disposed opposite to each other. The steam generation assembly 20 is disposed in the first mounting cavity 10*a* and connected to the clip ironing steam port 10*b* and the hanging ironing steam port 10*c*. The clamping plate 30 is rotatably connected to the housing 10 and disposed opposite to the clip ironing steam port 10*b*.

Specifically, in this embodiment, the housing 10 includes a main housing 11, a first clip ironing plate 12, and a hanging ironing plate 13. The main housing 11 may be molded from metal or a plastic material, and may be shaped based on needs. The main housing 11 is a hollow thin shell-like structure. The first clip ironing plate 12 and the hanging ironing plate 13 are made of heat-conducting materials such as ceramic, iron, aluminum, copper, and the like. The first clip ironing plate 12 and the hanging ironing plate 13 are detachably connected to the main housing 11 via a screw or a snap structure, and are enclosed with the main housing 11 to form the first mounting cavity 10*a*.

The first mounting cavity 10*a* is used to mount the steam generation assembly 20. The first clip ironing plate 12 and the hanging ironing plate 13 are spaced apart from each other in a vertical direction. The clip ironing steam port 10*b* is provided in the first clip ironing plate 12, and the hanging ironing steam port 10*c* is provided in the hanging ironing plate 13.

The steam generation assembly 20 includes a directional valve 21, a steam generator 22, and a water pump 23. The directional valve 21, the steam generator 22, and the water pump 23 are fastened to the first mounting cavity 10*a* by means of structures such as screws. The steam generator 22 is provided with a hanging ironing flow channel, a clip ironing flow channel, and a heating tube 221. The hanging ironing flow channel and the clip ironing flow channel are not connected to each other, and are respectively connected to the hanging ironing steam port 10*c* and the clip ironing steam port 10*b*. The heating tube 221 is correspondingly disposed with the hanging ironing flow channel and the clip ironing flow channel, to heat water flowing into the hanging ironing flow channel and the clip ironing flow channel and generate steam. The directional valve 21 is connected to the water pump 23, the hanging ironing flow channel, and the clip ironing flow channel. During specific application, the water pump 23 is used to pump water. The directional valve 21 delivers the water into the hanging ironing flow channel or the clamping ironing flow channel based on instructions of the user. The heating tube 221 heats the water flowing into the hanging ironing flow channel or the clamping ironing flow channel, to generate steam. The steam ejects from the clip ironing steam port 10*b* or the hanging ironing steam port 10*c* for ironing clothing.

The clamping plate 30 may be molded from metal or a plastic material. The clamping plate 30 is a shell-like cavity structure, and is provided with a second mounting cavity 30*b*. The second mounting cavity 30*b* is used to mount the controller 40 of the ironing device 100. Specifically, in order to facilitate the user to carry out clip ironing, in the present disclosure, an end of the clamping plate 30 is provided with a connection shaft 14 hole 30*a* in a forming manner, a connection shaft 14 is correspondingly disposed on the main housing 11. The connection shaft 14 may be rotatably nested in the connection shaft 14 hole 30*a*, to rotatably connect the clamping plate 30 to the main housing 11. To be specific, under action of an external force, the clamping plate 30 may rotate toward or away from a side of the main housing 11, and may match the first clip ironing plate 12, presenting a clipping or releasing state and conducting clip ironing on the clothing.

In the present disclosure, the ironing device 100 can implement the functions of clip ironing and hanging ironing of clothing via the clip ironing steam port 10*b* and the hanging ironing steam port 10*c* that are disposed opposite to each other and the clamping plate 30. Specifically, during clip ironing, the steam generation assembly 20 outputs steam to the clip ironing steam port 10*b*, the clamping plate 30 rotates upwardly relative to the housing 10, and the clothing can be placed between the steam generation assembly and the clamping plate for ironing. During hanging ironing, the steam generation assembly 20 outputs steam to the hanging ironing steam port 10*c*, and the housing 10 is attached to a surface of the clothing for hanging ironing. In this way, the ironing device 100 in the present disclosure has functions of hanging ironing and clip ironing, which can better adapt to different use scenarios, so that user experience is improved to a greater extent.

Figure 4:
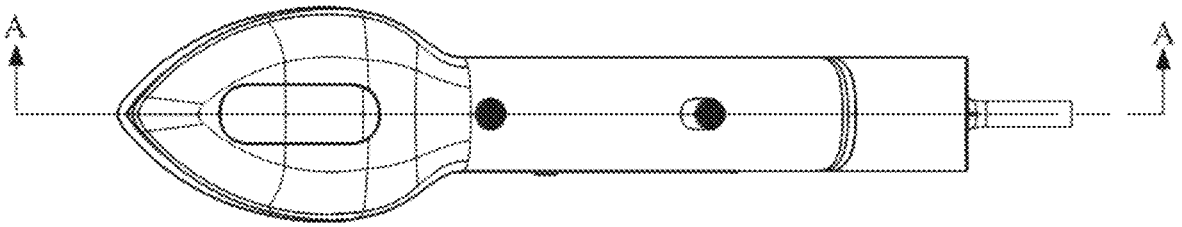
FIG. 4 is a top view of the ironing device in FIG. 2.
Figure 5:
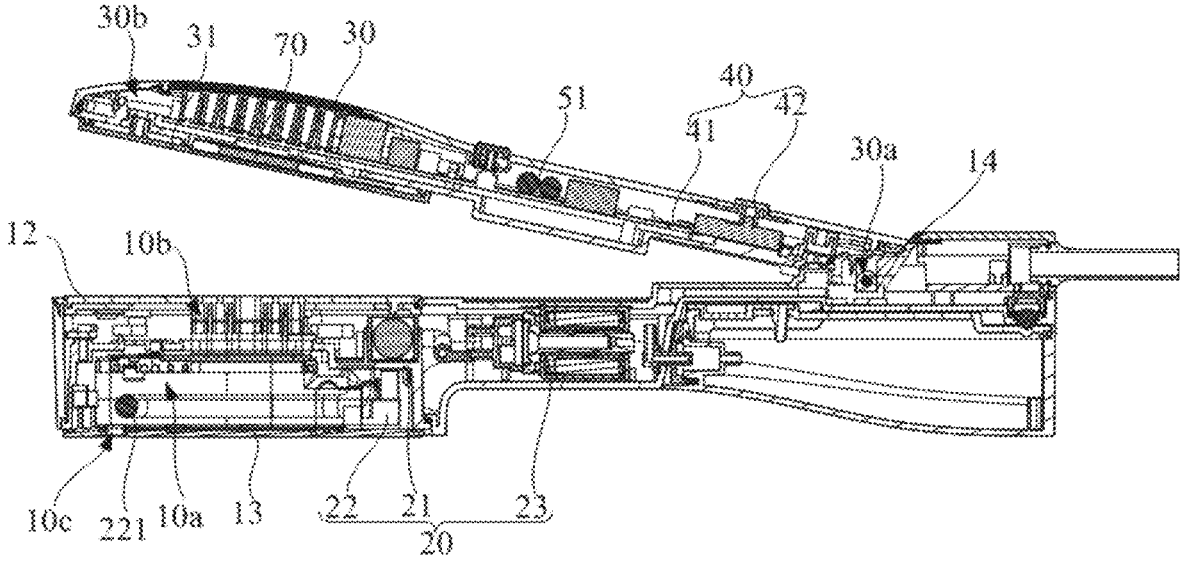
FIG. 5 is a sectional view of an ironing device along an A-A direction in FIG. 4.

Still referring to FIG. 4, in this embodiment, the ironing device 100 includes a controller 40 and a switching structure (not shown in the figure). The controller 40 includes a control circuit board 41 and a control switch 42. The control circuit board 41 includes a board body and a plurality of electronic elements that are soldered on a surface of the board body. The board body is a printed circuit board (PCB), and is secured in the second mounting cavity 30*b* via the screw. The control switch 42 is in communication connection to the control circuit board 41 in a soldering manner. The clamping plate 30 is provided with an avoidance hole connected to the second mounting cavity 30*b*. The control switch 42 is partially exposed via the avoidance hole, to facilitate the user to control a use method of the ironing device 100. The control circuit board 41 is in communication connection to the directional valve 21 via an electronic connection line, and the switching structure is in communication connection to the control circuit board 41 via the electronic connection line. The switching structure is used to control the directional valve 21 to deliver air to the clip ironing steam port 10*b* or the hanging ironing steam port 10*c*, to facilitate the user to select and switch a use mode of the ironing device 100.

Still referring again to FIG. 3 and FIG. 6, in an embodiment of the present disclosure, the switching structure includes a Hall switch 51 and a magnetic member 52. The Hall switch 51 is connected to the control circuit board 41 by soldering, to implement a communication connection to a main controller (not shown in the figures) on the control circuit board 41. The magnetic member 52 is mounted on the housing 10 and may move relative to the clamping plate 30. The magnetic member 52 may be a permanent magnet or a soft magnet. The ironing device 100 further includes a locking structure 60. The locking structure 60 includes a sliding latch 61 and a latch slot 62 that is provided on the clamping plate 30. The sliding latch 61 is slidably connected to the main housing 11, and may slidably reciprocate in a horizontal direction relative to the main housing 11. The sliding latch 61 has a snapping protrusion facing a side of the clamping plate 30, the snapping protrusion is recessed toward the side of the clamping plate 30, to form a mounting slot (not shown in the figure), and the magnetic member 52 is snapped into the mounting slot.

Figure 2:
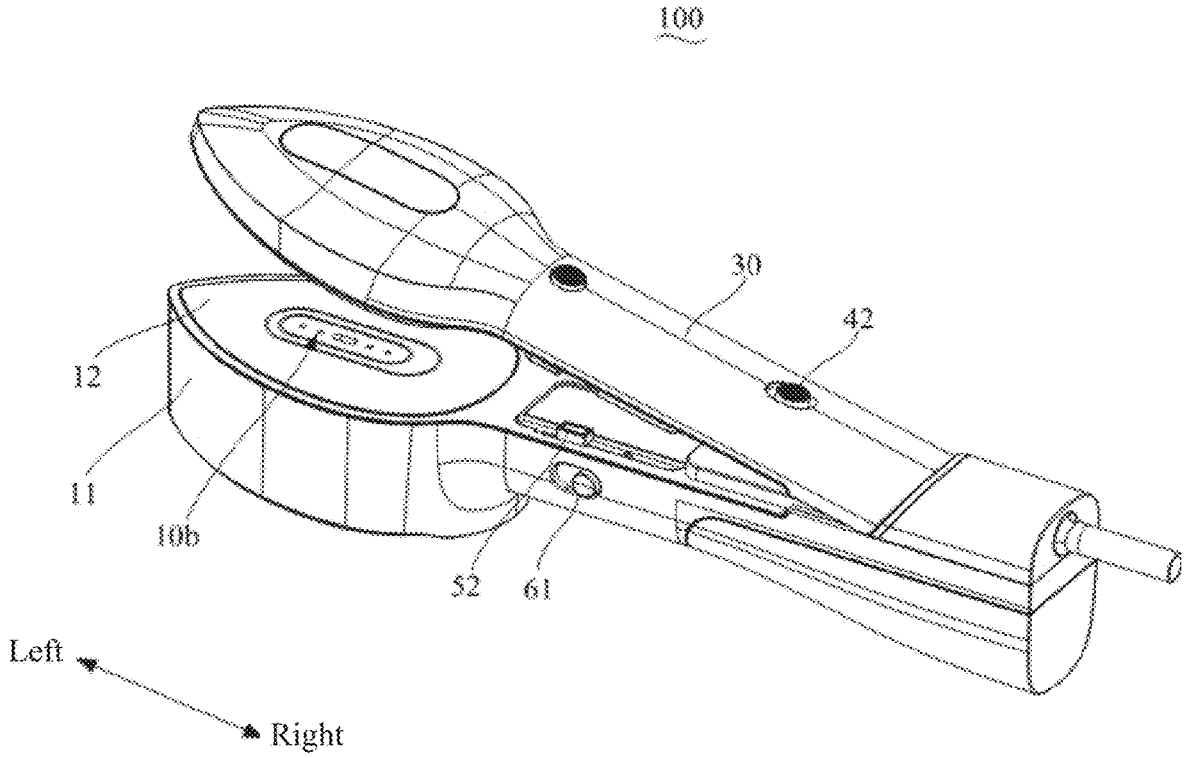
FIG. 2 is a schematic diagram of a structure of another status of the ironing device in FIG. 1.
Figure 3:
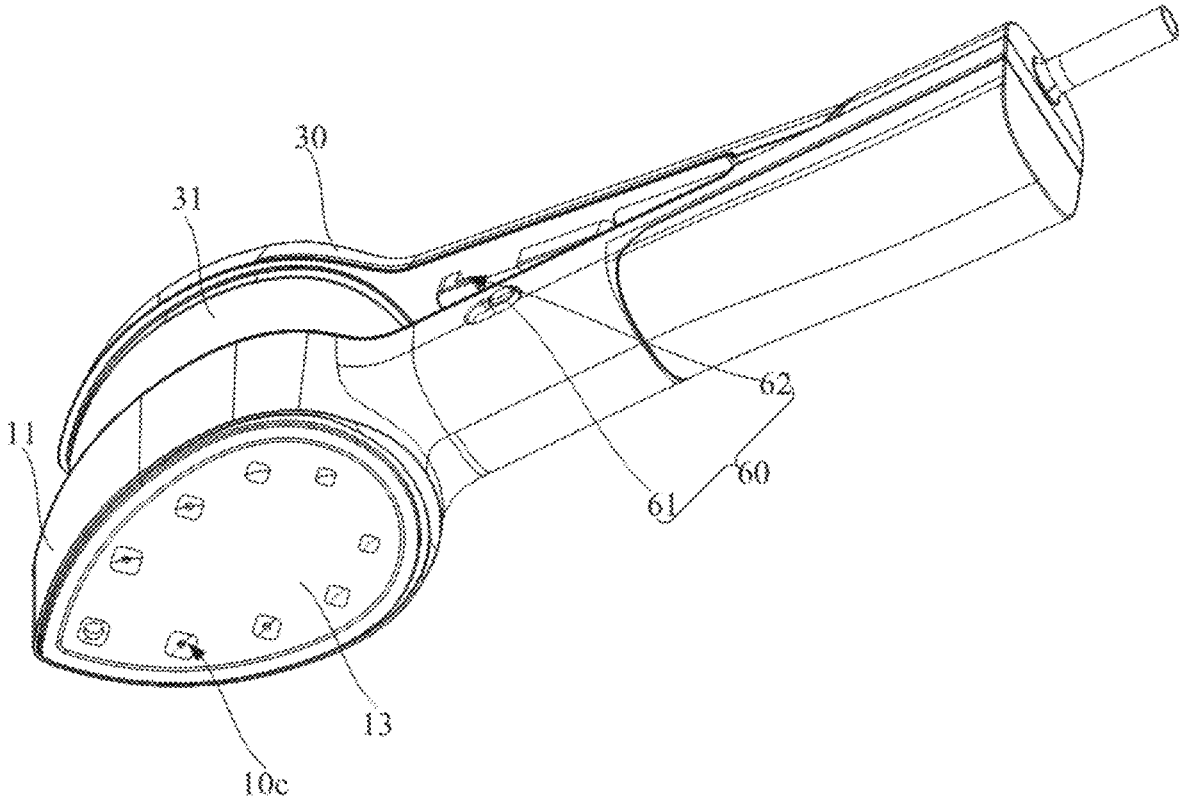
FIG. 3 is a schematic diagram of a structure of the ironing device in a viewing angle in FIG. 2.

Still referring to FIG. 1 and FIG. 2, in the present disclosure, when the clamping plate 30 is attached to a surface of the first clip ironing plate 12, the sliding latch 61 may be slid to the left side. In this case, the snapping protrusion is embedded in the latch slot 62, to connect the clamping plate 30 to the main housing 11 in a locking manner. This avoids the clamping plate 30 from rotating relative to the main housing 11. When the clamping plate 30 needs to be opened, the clamping plate 30 and the main housing 11 may be unlocked and released only by pulling the sliding latch 61 to the right. Therefore, operations are easy to be performed, and a structure is simple. In addition, because the magnetic member 52 is mounted on the sliding latch 61, the magnetic member 52 may trigger the Hall switch 51 in a sliding locking process of the sliding latch 61, to protect the ironing device 100 in a use state in a specific use mode. For example, in this embodiment, the use mode of the ironing device 100 may be controlled via a button switch. The use mode includes on/off functions, a hanging ironing mode, and a clip ironing mode. In the hanging ironing mode, it may be defined that the directional valve 21 only delivers steam to the hanging ironing steam port 10*c* regardless of whether the magnetic member 52 triggers the Hall switch 51. In this way, when the clamping plate 30 is in an on state, the user is not scalded by steam delivered from the clip ironing steam port 10*b*. In the clip ironing mode, it may be defined that the directional valve 21 delivers steam to the hanging ironing steam port 10*c* after the magnetic member 52 triggers the Hall switch 51. To be specific, when the sliding latch 61 slides to the right to unlock the clamping plate 30 and the clamping plate 30 is attached to the first clip ironing plate 12, the steam is delivered from the hanging ironing steam port 10*c*. In this way, the user is not scalded by steam delivered from the clip ironing steam port 10*b*. Therefore, safety of use of the ironing device 100 is better.

Figure 6:
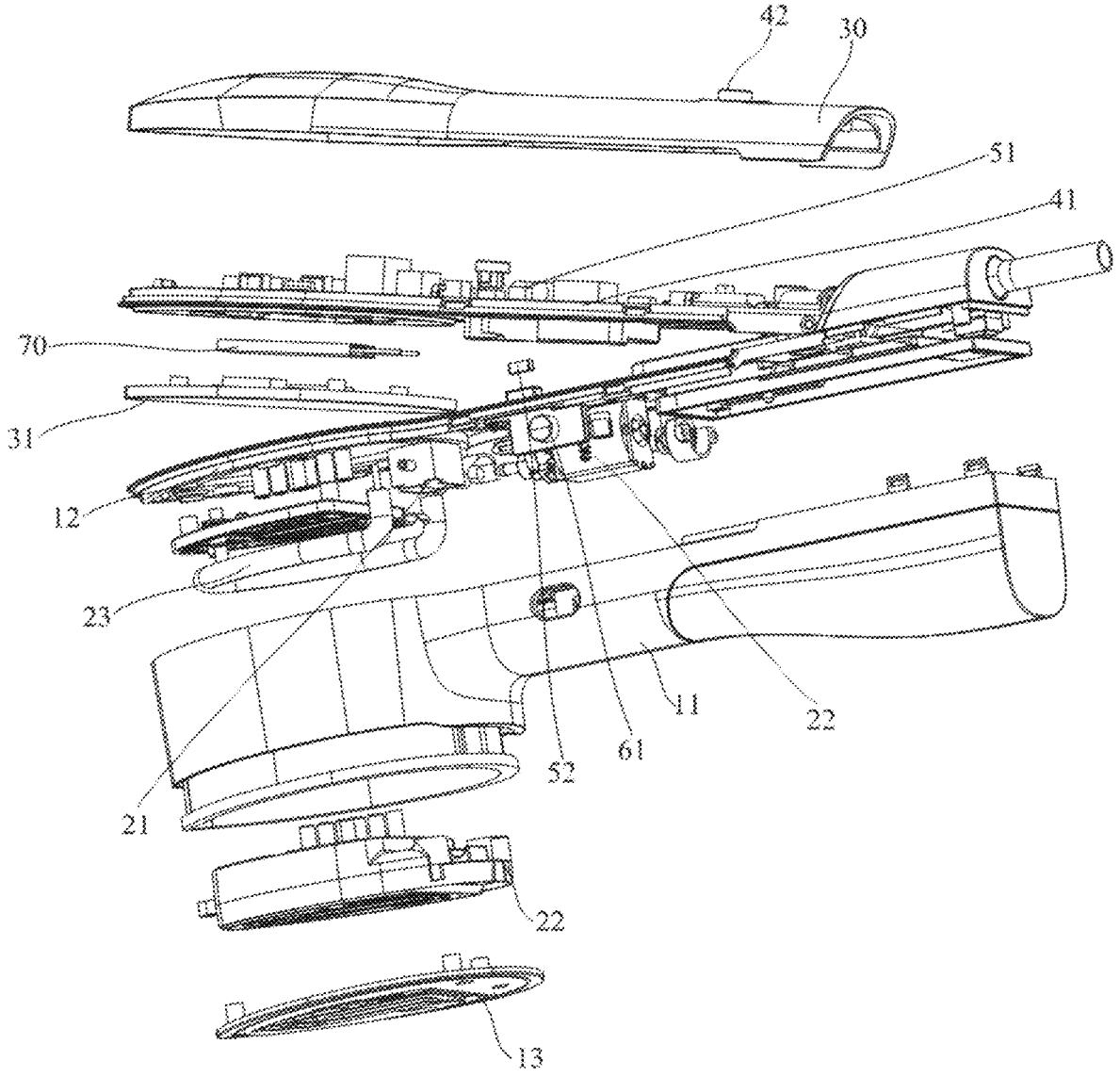
FIG. 6 is a structural exploded view of the ironing device in FIG. 2.

Further, still referring to FIG. 6, in an embodiment of the present disclosure, the ironing device 100 further includes a heating sheet 70 and a second clip ironing plate 31. The second clip ironing plate 31 is mounted on the clamping plate 30 and corresponds to the first clip ironing plate 12, and the heating sheet 70 is mounted on the clamping plate 30 and attached to a surface of the second clip ironing plate 31. In addition, the heating sheet 70 is connected to the control board 41 via the electronic connection line, and the control board 41 is used to control the heating sheet 70 to heat the second clip ironing plate 31. In this way, during actual use, the second clip ironing plate 31 assists in clip ironing, and evaporates high-temperature condensate on the surface of the first clip ironing plate 12. This avoids the high-temperature condensate from flowing into hands of the user, and further improves safety of use.

Further, in the present disclosure, the clip ironing steam port 10*b* includes a plurality of clip ironing holes (not shown in the figure), and the plurality of clip ironing holes are spaced apart from the first clip ironing plate 12. The hanging ironing steam port 10*c* includes a plurality of hanging ironing holes (not shown in the figure), and the plurality of hanging ironing holes are spaced apart from the hanging ironing plate 13. By means of the plurality of clip ironing holes and the plurality of hanging ironing holes, the steam is delivered more evenly. This improves effect of the clip ironing or the hanging ironing.

The above described are merely preferred embodiments of the present disclosure, which are not intended to limit the scope of the patent of the present disclosure. Any equivalent structure transformation made based on the description and accompanying drawings of the present disclosure, or direct or indirect application thereof in other related technical fields, should fall within the protection scope of the patent of the present disclosure.

What is claimed is:

1. An ironing device, comprising:

a housing, provided with a first mounting cavity, and a clip ironing steam port and a hanging ironing steam port that are connected to the first mounting cavity, wherein the clip ironing steam port and the hanging ironing steam port are disposed opposite to each other;

a steam generation assembly, disposed in the first mounting cavity and connected to the clip ironing steam port and the hanging ironing steam port;

wherein the steam generation assembly comprises a directional valve mounted in the first mounting cavity, a steam generator, and a water pump, the steam generator is connected to the clip ironing steam port and the hanging ironing steam port, and the directional valve is connected to the steam generator and the water pump;

a clamping plate, rotatably connected to the housing and disposed opposite to the clip ironing steam port; and a controller and a switching structure, wherein the controller is mounted on the clamping plate and in communication connection to the directional valve, and the switching structure is in communication connection to the controller and configured to control the directional valve to deliver steam to the clip ironing steam port or the hanging ironing steam port;

wherein the switching structure comprises a Hall switch and a magnetic member, the Hall switch is in communication connection to the controller, and the magnetic member is mounted in the housing and moves relative to the clamping plate.

2. The ironing device according to claim 1, further comprising a locking structure, wherein the locking structure is mounted on the housing and the clamping plate, and the magnetic member is mounted on the locking structure; and the locking structure connects or releases the housing and the clamping plate, and the magnetic member triggers the Hall switch.

3. The ironing device according to claim 2, wherein the locking structure comprises a sliding latch and a latch slot provided in the clamping plate, the sliding latch is connected to the housing, the magnetic member is connected to the sliding latch, and the sliding latch is slidably snapped into the latch slot.

4. The ironing device according to claim 3, wherein a connection shaft hole is provided at an end, away from the latch slot, of the clamping plate, and a connection shaft is disposed at an end, away from the sliding latch, of the housing, and the connection shaft is rotatably nested in the connection shaft hole.

5. The ironing device according to claim 4, wherein the housing comprises a main housing, a first clip ironing plate, and a hanging ironing plate, the first clip ironing plate and the hanging ironing plate are detachably connected to the main housing and enclosed with the main housing, to form the first mounting cavity, the clip ironing steam port is provided in the first clip ironing plate, and the hanging ironing steam port is provided in the hanging ironing plate.

6. The ironing device according to claim 2, wherein the housing comprises a main housing, a first clip ironing plate, and a hanging ironing plate, the first clip ironing plate and the hanging ironing plate are detachably connected to the main housing and enclosed with the main housing, to form the first mounting cavity, the clip ironing steam port is provided in the first clip ironing plate, and the hanging ironing steam port is provided in the hanging ironing plate.

7. The ironing device according to claim 3, wherein the housing comprises a main housing, a first clip ironing plate, and a hanging ironing plate, the first clip ironing plate and the hanging ironing plate are detachably connected to the main housing and enclosed with the main housing, to form the first mounting cavity, the clip ironing steam port is provided in the first clip ironing plate, and the hanging ironing steam port is provided in the hanging ironing plate.

8. The ironing device according to claim 1, wherein the housing comprises a main housing, a first clip ironing plate, and a hanging ironing plate, the first clip ironing plate and the hanging ironing plate are detachably connected to the main housing and enclosed with the main housing, to form the first mounting cavity, the clip ironing steam port is provided in the first clip ironing plate, and the hanging ironing steam port is provided in the hanging ironing plate.

9. The ironing device according to claim 8, further comprising a heating sheet and a second clip ironing plate, wherein the second clip ironing plate is mounted on the clamping plate and corresponds to the first clip ironing plate, and the heating sheet is mounted on the clamping plate and attached to a surface of the second clip ironing plate.

10. The ironing device according to claim 8, wherein the clip ironing steam port comprises a plurality of clip ironing holes, and the plurality of clip ironing holes are spaced apart from the first clip ironing plate; and the hanging ironing steam port comprises a plurality of hanging ironing holes, and the plurality of the hanging ironing holes are spaced apart in the hanging ironing plate.

11. The ironing device according to claim 1, wherein the housing comprises a main housing, a first clip ironing plate, and a hanging ironing plate, the first clip ironing plate and the hanging ironing plate are detachably connected to the main housing and enclosed with the main housing, to form the first mounting cavity, the clip ironing steam port is provided in the first clip ironing plate, and the hanging ironing steam port is provided in the hanging ironing plate.

12. The ironing device according to claim 1, wherein the housing comprises a main housing, a first clip ironing plate, and a hanging ironing plate, the first clip ironing plate and the hanging ironing plate are detachably connected to the main housing and enclosed with the main housing, to form the first mounting cavity, the clip ironing steam port is provided in the first clip ironing plate, and the hanging ironing steam port is provided in the hanging ironing plate.

13. The ironing device according to claim 1, wherein the housing comprises a main housing, a first clip ironing plate, and a hanging ironing plate, the first clip ironing plate and the hanging ironing plate are detachably connected to the main housing and enclosed with the main housing, to form the first mounting cavity, the clip ironing steam port is provided in the first clip ironing plate, and the hanging ironing steam port is provided in the hanging ironing plate.

* * * * *